US010235858B1

(12) United States Patent
Flippen

(10) Patent No.: US 10,235,858 B1
(45) Date of Patent: Mar. 19, 2019

(54) PERSONAL PROXIMITY WARNING DEVICE

(71) Applicant: Donna Flippen, Queens Village, NY (US)

(72) Inventor: Donna Flippen, Queens Village, NY (US)

( * ) Notice: Subject to any disclaimer, the term of this patent is extended or adjusted under 35 U.S.C. 154(b) by 0 days.

(21) Appl. No.: 15/834,930

(22) Filed: Dec. 7, 2017

(51) Int. Cl.
*G08B 21/02* (2006.01)
*G08C 23/04* (2006.01)

(52) U.S. Cl.
CPC ..... *G08B 21/02* (2013.01); *G08C 23/04* (2013.01)

(58) Field of Classification Search
CPC .. G08B 21/22; G08B 25/0116; G08B 25/016; A01M 31/02
USPC ..... 340/500, 573.2, 539.11, 539.23
See application file for complete search history.

(56) References Cited

U.S. PATENT DOCUMENTS 5,283,549 A * 2/1994 Mehaffey ..... G08B 13/19 340/460
D362,920 S 10/1995 Schwartz
5,627,518 A * 5/1997 Wishart ..... G08B 13/19 340/567
6,211,783 B1 * 4/2001 Wang ..... G08B 21/0415 340/506
6,861,970 B1 * 3/2005 Garland ..... G01S 7/4806 342/175
7,268,689 B2 9/2007 Sulaver
7,751,285 B1 * 7/2010 Cain ..... G04G 9/0017 368/10
2006/0097883 A1 5/2006 Lamar
2007/0022974 A1 2/2007 Aebi
2007/0063851 A1 * 3/2007 Addison ..... G08B 21/22 340/573.1
2007/0205890 A1 9/2007 Brown
2008/0061962 A1 * 3/2008 Campman ..... G07C 9/00111 340/539.13
2011/0025492 A1 2/2011 Bravo
2015/0070181 A1 * 3/2015 Fadell ..... G08B 21/22 340/628
2015/0156567 A1 * 6/2015 Oliver ..... H04W 4/80 340/870.07
2016/0148495 A1 * 5/2016 Buchanan ..... A61N 1/39 340/539.17
2016/0189532 A1 * 6/2016 Malhotra ..... G08B 29/185 340/506
2017/0229004 A1 * 8/2017 Shah ..... F41H 9/10
2017/0263107 A1 * 9/2017 Doyle ..... G08B 25/016
2018/0055457 A1 * 3/2018 Balboni ..... A61B 5/746

* cited by examiner

*Primary Examiner* — Eric Blount

(57) ABSTRACT

A personal proximity warning device for warning a user of an animal in proximity to the user includes a band that is luminescent. The band is configured to position around a wrist of the user. A sensor is coupled to a housing that is coupled to the band. A communication module that is positioned in the housing is operationally coupled to the sensor. The communication module is voice-activated, GPS-enabled, and is configured to communicate wirelessly. The sensor, which is passive infrared-type, is configured to detect an animal in proximity to the user and to signal the communication module, which then is compelled to alert the user. The communication module is configured to receive a voice command from the user, to receive and to communicate location coordinates of the user, and to selectively contact at least one emergency service and at least one cellular phone.

1 Claim, 3 Drawing Sheets

PERSONAL PROXIMITY WARNING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to proximity warning devices and more particularly pertains to a new proximity warning device for warning a user of an animal in proximity to the user.

BRIEF SUMMARY OF THE INVENTION

An embodiment of the disclosure meets the needs presented above by generally comprising a band that is luminescent. The band is configured to position around a wrist of the user. A sensor is coupled to a housing that is coupled to the band. A communication module that is positioned in the housing is operationally coupled to the sensor. The communication module is voice-activated, GPS-enabled, and is configured to communicate wirelessly. The sensor, which is passive infrared-type, is configured to detect an animal in proximity to the user and to signal the communication module, which then is compelled to alert the user. The communication module is configured to receive a voice command from the user, to receive and to communicate location coordinates of the user, and to selectively contact at least one emergency service and at least one cellular phone.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
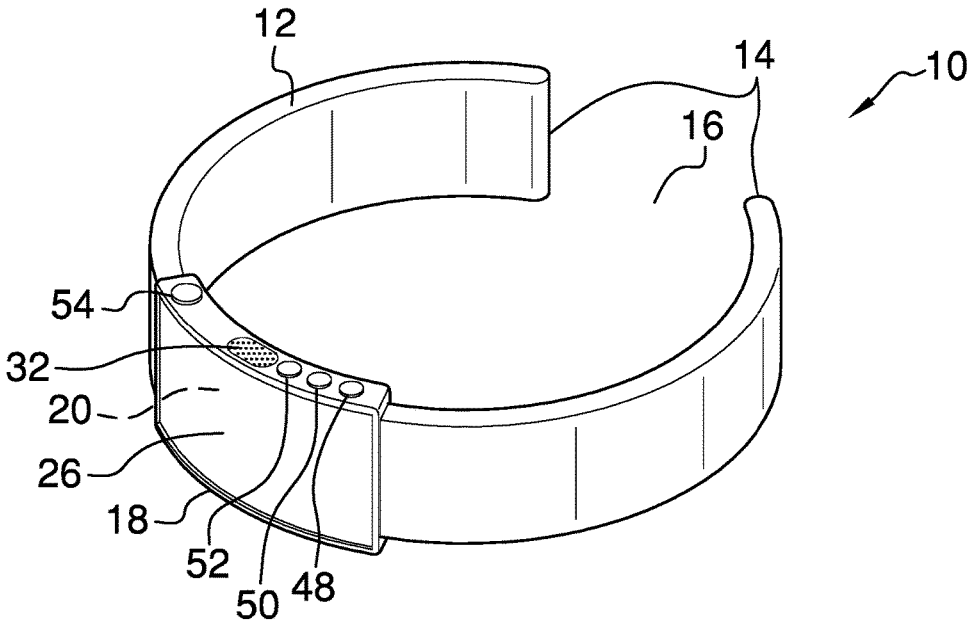
FIG. 1 is an isometric perspective view of a personal proximity warning device according to an embodiment of the disclosure.
Figure 2:
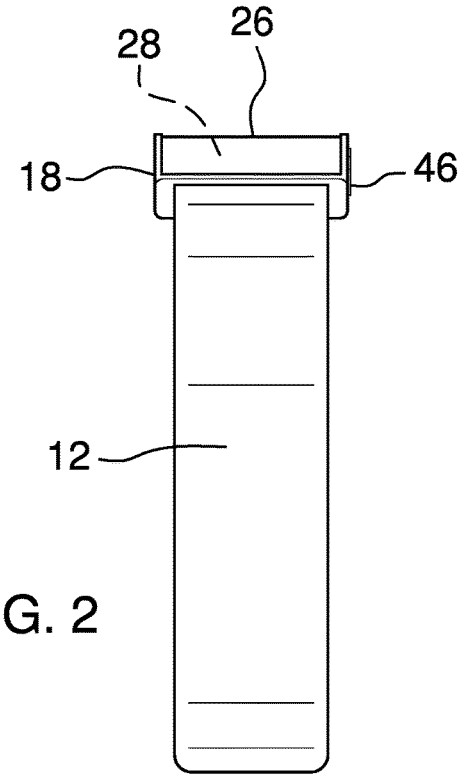
FIG. 2 is a side view of an embodiment of the disclosure.
Figure 3:
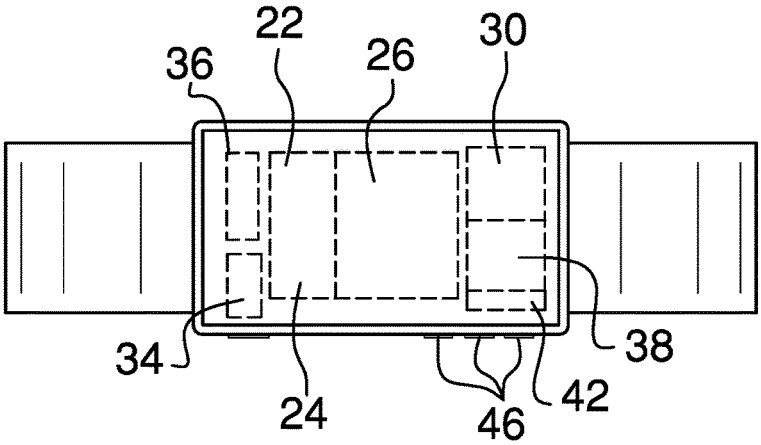
FIG. 3 is a top view of an embodiment of the disclosure.
Figure 4:
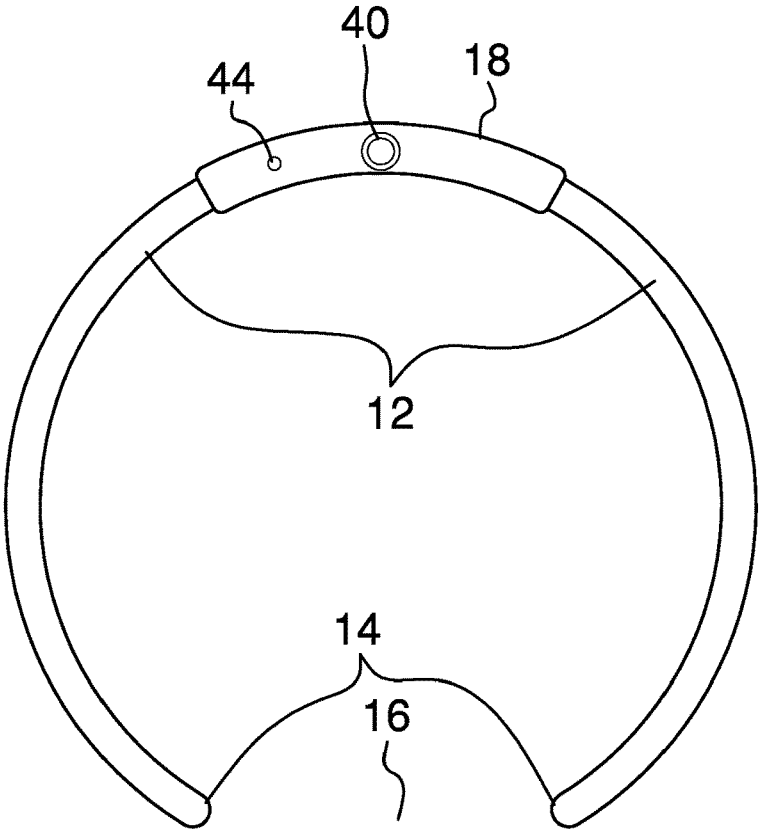
FIG. 4 is a back view of an embodiment of the disclosure.
Figure 5:
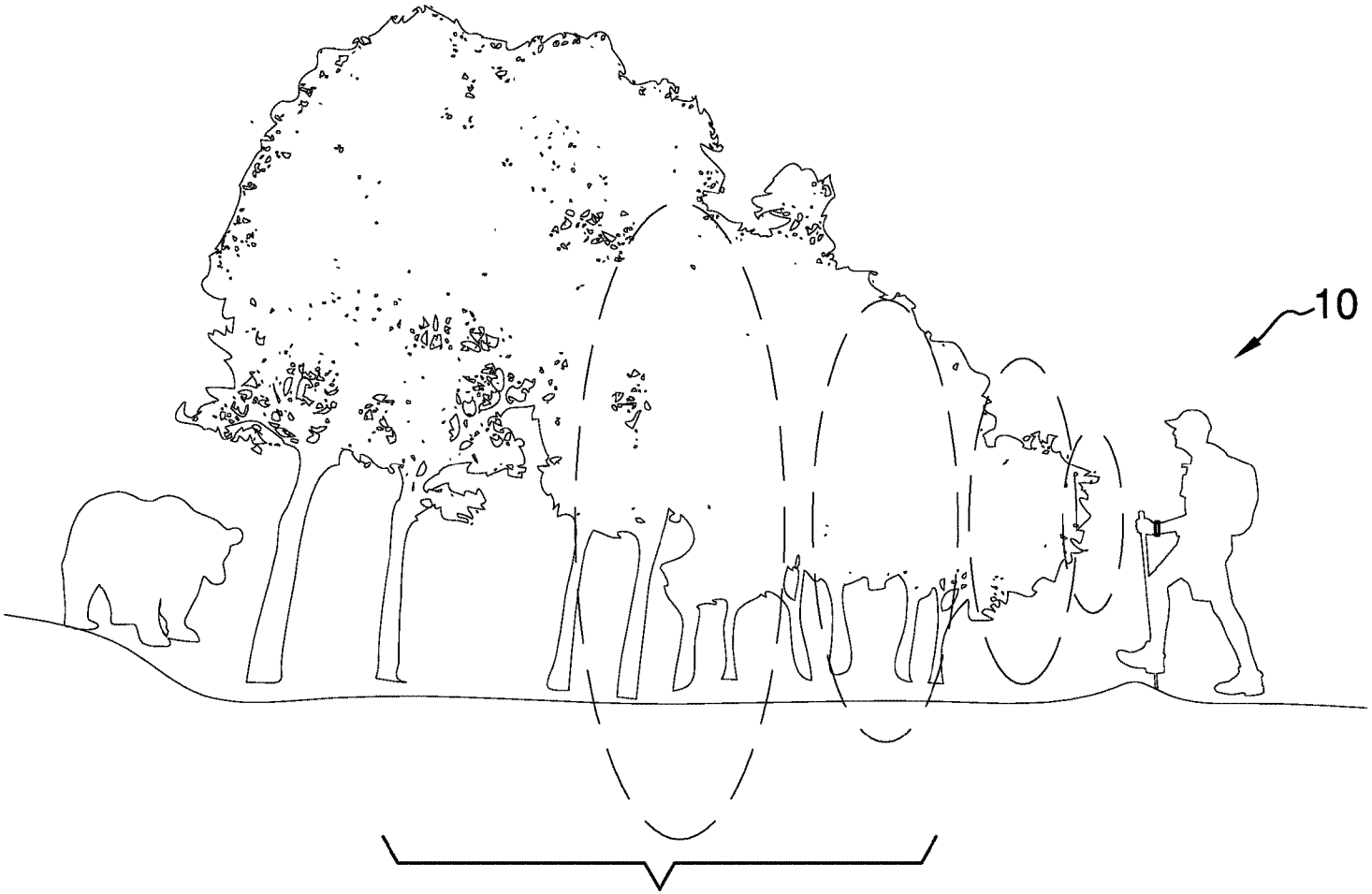
FIG. 5 is an in-use view of an embodiment of the disclosure.

With reference now to the drawings, and in particular to FIGS. 1 through 5 thereof, a new proximity warning device embodying the principles and concepts of an embodiment of the disclosure and generally designated by the reference numeral 10 will be described.

As best illustrated in FIGS. 1 through 5, the personal proximity warning device 10 generally comprises a band 12 that is luminescent. The band 12 is configured to position around a wrist of a user to couple the band 12 to the user. In one embodiment, the band 12 has opposing ends 14 that define a gap 16. The band 12 comprises rubber so that the band 12 is resilient. The opposing ends 14 are configured to be separated so that the gap 16 is configured to insert the wrist of the user to couple the band 12 to the user.

A housing 18 is coupled to the band 12. The housing 18 defines an interior space 20. In one embodiment, the housing 18 is evenly spaced between the opposing ends 14 of the band 12.

A power module 22 is coupled to the housing 18 and is positioned in the interior space 20. In one embodiment, the power module 22 comprises at least one battery 24. A sensor 26 is coupled to the housing 18. The sensor 26 is passive infrared-type. The sensor 26 is configured to detect an animal, such as a mountain lion or a human, in an area proximate to the use.

A communication module 28 is coupled to the housing 18 and is positioned in the interior space 20. The communication module 28 is operationally coupled to the sensor 26. The communication module 28 is voice-activated. The communication module 28 is configured to communicate wirelessly. The communication module 28 is Global Positioning System enabled. The sensor 26 is configured to detect the animal in the area proximate to the user and to signal the communication module 28. The communication module 28 is compelled to alert the user. The communication module 28 is configured to receive a voice command from the user, such as "911". The communication module 28 is compelled to receive location coordinates of the user and to selectively contact at least one emergency service, such as a police department, and at least one cellular phone, such as a cellular phone of a parent of the user, and to communicate the location coordinates of the user.

The communication module 28 comprises a microprocessor 30 that is coupled to the housing 18 and is positioned in the interior space 20. The microprocessor 30 is operationally coupled to the power module 22. The sensor 26 is operationally coupled to the microprocessor 30. A speaker 32 is coupled to the housing 18. The speaker 32 is operationally coupled to the microprocessor 30. The microprocessor 30 is positioned to compel the speaker 32 to emit an audible alert to the user.

A transmitter 34 and a receiver 36 are coupled to the housing 18 and are positioned in the interior space 20. The transmitter 34 and the receiver 36 are operationally coupled to the microprocessor 30. The transmitter 34 is configured to communicate wirelessly. The receiver 36 is Global Positioning System enabled. The microprocessor 30 is positioned to compel the receiver 36 to receive the location coordinates of the user and to relay the location coordinates to the microprocessor 30. The microprocessor 30 is positioned to compel the transmitter 34 to transmit the location coordinates of the user to the at least one emergency service, such as the police department, and the at least one cellular phone, such as the cellular phone of the parent of the user.

In one embodiment, a data storage module 38 is coupled to the housing 18 and is positioned in the interior space 20. The data storage module 38 is operationally coupled to the microprocessor 30. The data storage module 38 is configured to store a plurality of audio files.

A port 40 is coupled to the housing 18. The port 40 is operationally coupled to the microprocessor 30. The port 40 is configured to operationally couple to headphones. The microprocessor 30 is positioned to compel the data storage module 38 to transmit a respective audio file to the headphones to broadcast the respective audio file to the ears of the user.

In another embodiment, a transceiver 42 is coupled to the housing 18 and is positioned in the interior space 20. The transceiver 42 is operationally coupled to the microprocessor 30. The transceiver 42 is Bluetooth™ enabled. The transceiver 42 is configured to pair with an electronic device of the user to transfer the plurality of audio files to the data storage module 38. The transceiver 42 also is configured to pair with wireless headphones of the user.

The data storage module 38 is positioned to transmit a respective audio file to the wireless headphones via the transceiver 42 to broadcast the respective audio file to the ears of the user. The microprocessor 30 is positioned to compel the transceiver 42 to selectively terminate the broadcast of the respective audio file and to compel the transceiver 42 to transmit the audible alert to the wireless headphones to broadcast the audible alert to the ears of the user.

A microphone 44 to the housing 18. The microphone 44 is operationally coupled to the microprocessor 30. The microphone 44 is configured to capture the respective voice command, such as "911" and "Play", and to relay the respective voice command to the microprocessor 30.

A controller 46 is coupled to the housing 18. The controller 46 is operationally coupled to the microprocessor 30. The controller 46 is positioned to input commands into the microprocessor 30 so that the microprocessor 30 is compelled to selectively adjust a volume of the speaker 32, the headphones, and the wireless headphones. The controller 46 also is positioned to compel the microprocessor 30 to adjust a sensitivity of the sensor 26.

In one embodiment, the controller 46 comprises a first button 48, a second button 50, a third button 52, and a fourth button 54. The first button 48, the second button 50, the third button 52, and the fourth button 54 are depressible. The first button 48 is configured to be depressed to couple the microprocessor 30 to the power module 22. The second button 50 is configured to be depressed to decouple the microprocessor 30 from the power module 22. The third button 52 is configured to be depressed to selectively adjust the volume of the speaker 32, the headphones, and the wireless headphones. The fourth button 54 is configured to be depressed to adjust the sensitivity of the sensor 26.

In use, the gap 16 is positioned in the band 12 so that the opposing ends 14 are configured to be separated. The gap 16 is configured to insert the wrist of the user to couple the band 12 to the user. The first button 48 is configured to be depressed to couple the microprocessor 30 to the power module 22. The fourth button 54 is configured to be depressed to adjust the sensitivity of the sensor 26. The sensor 26 is configured to detect the animal in the area proximate to the user and to signal the microprocessor 30. The microprocessor 30 is positioned to compel the speaker 32 to emit the audible alert to the user. The microphone 44 is configured to capture the respective voice command, such as "911", and to relay the respective voice command to the microprocessor 30. The microprocessor 30 is positioned to compel the receiver 36 to receive the location coordinates of the user and to relay the location coordinates to the microprocessor 30. The microprocessor 30 is positioned to compel the transmitter 34 to transmit the location coordinates of the user to the at least one emergency service, such as the police department, and the at least one cellular phone, such as the cellular phone of the parent of the user.

The port 40 is configured to couple to the headphones. The microprocessor 30 is positioned to compel the data storage module 38 to transmit the respective audio file to the headphones to broadcast the respective audio file to the ears of the user. The microphone 44 is configured to capture the respective voice command, such as "Play", and to relay the respective voice command to the microprocessor 30. The transceiver 42 is configured to pair with the electronic device of the user to transfer the plurality of audio files to the data storage module 38. The transceiver 42 also is configured to pair with the wireless headphones of the user. The data storage module 38 is positioned to transmit a respective audio file to the wireless headphones via the transceiver 42 to broadcast the respective audio file to the ears of the user. The third button 52 is configured to be depressed to selectively adjust the volume of the speaker 32, the headphones, and the wireless headphones.

The microprocessor 30 is positioned to compel the transceiver 42 to selectively terminate the broadcast of the respective audio file and to compel the transceiver 42 to transmit the audible alert to the wireless headphones to broadcast the audible alert to the ears of the user. The second button 50 is configured to be depressed to decouple the microprocessor 30 from the power module 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal proximity warning device comprising:

a band configured for positioning around a wrist of a user such that said band is coupled to the user, said band being luminescent, said band having opposing ends defining a gap, said band comprising rubber such that said band is resilient, wherein said gap is positioned in said band such that said opposing ends are configured for separating such that said gap is configured for inserting the wrist of the user for coupling said band to the user;

a housing coupled to said band, said housing defining an interior space, said housing being evenly spaced between said opposing ends of said band;

a power module coupled to said housing and positioned in said interior space, said power module comprising at least one battery;

a sensor coupled to said housing, said sensor being passive infrared-type such that said sensor is configured for detecting an animal in an area proximate to the use;

a communication module coupled to said housing and positioned in said interior space, said communication module being operationally coupled to said sensor, said communication module being voice-activated, said communication module being configured for communicating wirelessly, said communication module being Global Positioning System enabled, wherein said sensor is positioned on said band such that said sensor is configured for detecting the animal in the area proximate to the user and for signaling said communication module such that said communication module is compelled for alerting the user, wherein said communication module is configured for receiving a voice command from the user such that said communication module is compelled for receiving location coordinates of the user and for selectively contacting at least one emergency service and at least one cellular phone and for communicating the location coordinates of the user, said communication module comprising:

a microprocessor coupled to said housing and positioned in said interior space, said microprocessor being operationally coupled to said power module, said sensor being operationally coupled to said microprocessor, a speaker coupled to said housing, said speaker being operationally coupled to said microprocessor, wherein said speaker is positioned on said housing such that said microprocessor is positioned for compelling said speaker for emitting an audible alert to the user, a transmitter coupled to said housing and positioned in said interior space, said transmitter being operationally coupled to said microprocessor, said transmitter being configured for communicating wirelessly, a receiver coupled to said housing and positioned in said interior space, said receiver being operationally coupled to said microprocessor, said receiver being global positioning system enabled, wherein said receiver is positioned in said housing such that said microprocessor is positioned for compelling said receiver for receiving the location coordinates of the user and for relaying the location coordinates to said microprocessor, such that said microprocessor is positioned for compelling said transmitter for transmitting the location coordinates of the user to the at least one emergency service and the at least one cellular phone, a data storage module coupled to said housing and positioned in said interior space, said data storage module being operationally coupled to said microprocessor, said data storage module being configured for storing a plurality of audio files, a port coupled to said housing, said port being operationally coupled to said microprocessor, said port being configured for operationally coupling to headphones, wherein said port is positioned on said housing such that said port is configured for coupling to the headphones such that said microprocessor is positioned for compelling said data storage module for transmitting a respective audio file to the headphones for broadcasting the respective audio file to the ears of the user, a transceiver coupled to said housing and positioned in said interior space, said transceiver being operationally coupled to said microprocessor, said transceiver being Bluetooth™ enabled, wherein said transceiver is positioned in said housing such that said transceiver is configured for pairing with an electronic device of the user for transferring the plurality of audio files to said data storage module, and for pairing with wireless headphones of the user such that said data storage module is positioned for transmitting a respective audio file to the wireless headphones via said transceiver for broadcasting the respective audio file to the ears of the user, wherein said microprocessor is positioned for compelling said transceiver for selectively terminating the broadcasting of the respective audio file and for compelling said transceiver for transmitting the audible alert to the wireless headphones for broadcasting the audible alert to the ears of the user, a microphone coupled to said housing, said microphone being operationally coupled to said microprocessor, wherein said microphone is positioned on said housing such that said microphone is configured for capturing the respective voice command and for relaying the respective voice command to said microprocessor, and a controller coupled to said housing, said controller being operationally coupled to said microprocessor, wherein said controller is positioned on said housing such that said controller is positioned for inputting commands into said microprocessor such that said microprocessor is compelled for selectively adjusting a volume of said speaker, the headphones, and the wireless headphones, and for adjusting a sensitivity of said sensor, said controller comprising a first button, a second button, a third button, and a fourth button, said first button, said second button, said third button, and said fourth button being depressible, wherein said first button is positioned on said housing such that said first button is configured for depressing for coupling said microprocessor to said power module, wherein said second button is positioned on said housing such that said second button is configured for depressing for decoupling said microprocessor from said power module, wherein said third button is positioned on said housing such that said third button is configured for depressing for selectively adjusting the volume of said speaker, the headphones, and the wireless headphones, wherein said fourth button is positioned on said housing such that said fourth button is configured for depressing for adjusting the sensitivity of said sensor; and wherein said gap is positioned in said band such that said opposing ends are configured for separating such that said gap is configured for inserting the wrist of the user for coupling said band to the user, wherein said first button is positioned on said housing such that said first button is configured for depressing for coupling said microprocessor to said power module, wherein said fourth button is positioned on said housing such that said fourth button is configured for depressing for adjusting the sensitivity of said sensor, wherein said sensor is positioned on said band such that said sensor is configured for detecting the animal in the area proximate to the user and for signaling said microprocessor such that said microprocessor is positioned for compelling said speaker for emitting the audible alert to the user, wherein said microphone is positioned on said housing such that said microphone is configured for capturing the respective voice command and for relaying the respective voice command to said microprocessor such that said microprocessor is positioned for compelling said receiver for receiving the location coordinates of the user and for relaying the location coordinates to said microprocessor, such that said microprocessor is positioned for compelling said transmitter for transmitting the location coordinates of the user to the at least one emergency service and the at least one cellular phone wherein said port is positioned on said housing such that said port is configured for coupling to the headphones such that said microprocessor is positioned for compelling said data storage module for transmitting the respective audio file to the headphones for broadcasting the respective audio file to the ears of the user, wherein said microphone is positioned on said housing such that said microphone is configured for capturing the respective voice command and for relaying the respective voice command to said microprocessor, wherein said transceiver is positioned in said housing such that said transceiver is configured for pairing with the electronic device of the user for transferring the plurality of audio files to said data storage module, and for pairing with the wireless headphones of the user such that said data storage module is positioned for transmitting a respective audio file to the wireless headphones via said transceiver for broadcasting the respective audio file to the ears of the user, wherein said third button is positioned on said housing such that said third button is configured for depressing for selectively adjusting the volume of said speaker, the headphones, and the wireless headphones, wherein microprocessor is positioned for compelling said transceiver for selectively terminating the broadcasting of the respective audio file and for compelling said transceiver for transmitting the audible alert to the wireless headphones for broadcasting the audible alert to the ears of the user, wherein said second button is positioned on said housing such that said second button is configured for depressing for decoupling said microprocessor from said power module.

* * * * *